US008555962B2

(12) United States Patent
Vestavik

(10) Patent No.: US 8,555,962 B2
(45) Date of Patent: Oct. 15, 2013

(54) DOWNHOLE TOOL UNIT

(75) Inventor: Ola M. Vestavik, Eggebønes (NO)

(73) Assignee: Reelwell AS (NO)

( * ) Notice: Subject to any disclaimer, the term of this patent is extended or adjusted under 35 U.S.C. 154(b) by 239 days.

(21) Appl. No.: 13/121,685

(22) PCT Filed: Sep. 30, 2009

(86) PCT No.: PCT/NO2009/000340

§ 371 (c)(1),
(2), (4) Date: Jun. 21, 2011

(87) PCT Pub. No.: WO2010/039043

PCT Pub. Date: Apr. 8, 2010

(65) Prior Publication Data

US 2011/0240285 A1 Oct. 6, 2011

(30) Foreign Application Priority Data

Oct. 1, 2008 (NO) ..... 20084146

(51) Int. Cl.
*E21B 17/18* (2006.01)
*E21B 21/12* (2006.01)
*E21B 23/00* (2006.01)

(52) U.S. Cl.
USPC ..... 166/188; 166/133; 166/150; 166/183; 175/215

(58) Field of Classification Search
USPC ..... 175/215; 166/133, 150, 183, 188
See application file for complete search history.

(56) References Cited

U.S. PATENT DOCUMENTS

| | | | | |
|---|---|---|---|---|
| 2,602,516 | A * | 7/1952 | Gray | 175/65 |
| 3,638,742 | A | 2/1972 | Wallace | |
| 4,274,497 | A * | 6/1981 | Willis et al. | 175/100 |
| 4,296,807 | A | 10/1981 | Hendrickson et al. | |
| 4,534,426 | A | 8/1985 | Hooper | |
| 5,044,432 | A | 9/1991 | Cunningham et al. | |
| 5,526,887 | A | 6/1996 | Vestavik | |
| 6,176,311 | B1 * | 1/2001 | Ryan | 166/99 |
| 7,748,459 | B2 * | 7/2010 | Johnson | 166/308.1 |
| 2002/0070023 | A1 | 6/2002 | Turner | |
| 2003/0178198 | A1 | 9/2003 | Turner | |
| 2006/0045757 | A1 | 3/2006 | Parr | |
| 2008/0314644 | A1 * | 12/2008 | Cayeux | 175/215 |

OTHER PUBLICATIONS

Norwegian search report in NO 20084146, dated Apr. 30, 2009.

* cited by examiner

*Primary Examiner* — Giovanna Wright
(74) *Attorney, Agent, or Firm* — Adenike Adebiyi

(57) ABSTRACT

The invention concerns a unit for a down hole well tool comprising a tool unit comprising at least one first fluid conduit and a return fluid conduit in use forming a well annulus space between the tool unit and the well bore. The tool unit is arranged with at least one piston provided for dividing the well annulus space into at least two well annulus spaces. The communication of fluid between the adjacent well annulus spaces at each side of the piston is controlled by the relative movement between the first fluid conduit and a control element.

13 Claims, 6 Drawing Sheets

DOWNHOLE TOOL UNIT

FIELD

The invention concerns a unit for a down hole well tool.

The invention further concerns control of the communication between adjacent well annulus spaces separated by one or several pistons provided in connection with down hole well tools.

BACKGROUND

U.S. Patent Publication No. 2002/070023 ("Turner et al.) discloses a completion string including a base pipe having a hole, a packer in mechanical communication with the base pipe, and an isolation pipe concentric with the base pipe and proximate to the hole in the base pipe, with an annulus defined between the base pipe and the isolation pipe. An annulus-to-annulus valve is in mechanical communication with the base pipe and isolation pipe.

U.S. Patent Publication No. 2003/0178198 ("Turner et al.) discloses an isolation string having an upper packer and an isolation pipe in mechanical communication with the upper packer. The isolation pipe a pressure activated valve and an object activated valve.

U.S. Pat. No. 4,534,426 ("Hooper") shows a tool including a drill bit in combination with an expansible packer means for sealing with the well bore above the bit and fluid circulating means.

U.S. Pat. No. 4,296,807 ("Hendrickson et al.") shows a crossover tool for use with concentric tubing strings. The crossover tool is run into the well on the end of a drill pipe. The crossover tool includes a body about which a sleeve is slidably disposed. Movement of the outer sleeve by reciprocating the drill pipe changes the mode of operation of the crossover tool.

U.S. Patent Publication No. 2006/0045757 ("Parr") shows a production tool in which a packer is attached to a tubing string so that the well bore is divided into two annular spaces. Compressed gas is introduced into the annular space above the packer. There is the possibility of communication between the two spaces on either side of the packer in that the tubing is provided with holes for passage of fluid into its interior.

U.S. Pat. No. 3,638,742 ("Wallace") shows a dual string with an annular seal mounted between the dual string and the well bore wall.

U.S. Pat. No. 5,526,887 ("Vestavik") discloses a piston mounted on a drill string and adapted to form a sliding seal against the wall of borehole. A seal is arranged between the wall of the borehole and the drill string and above the piston. A pipe extends from a pressure-controlled pump, through the seal, into a volume between the seal and piston. Fluid can be pumped into the volume to exert pressure on the piston, which will urge the drill string against the bottom of the borehole. A return line extends from below the piston, through holes in the piston and seal, to the surface.

U.S. Pat. No. 5,044,432 ("Cunningham et al.") discloses a well pipe hanger with a metal sealing annulus valve.

SUMMARY

The unit for a down hole well tool comprises a tool unit. The tool unit comprises at least one first fluid conduit and a return fluid conduit, and is to be installed in a well bore wherein a space in the form of a well annulus is formed between the tool unit and the well bore. The return fluid conduit may be arranged in the first fluid conduit, leaving an annular space in between the first fluid conduit and the return fluid conduit for the flow of the first fluid, wherein the return fluid conduit passes in the centrally arranged space of the return fluid conduit.

The unit for a down hole well tool in accordance with the invention may be used for drilling, well cleaning, installation of casing, well completion, workovers and for other well operations.

Further the tool unit is arranged with at least one piston provided for dividing the well annulus into at least two well annulus spaces. The annulus spaces are preferably displaced in the axial direction of the well bore. The piston may be provided by a separate element arranged on to the first fluid conduit or may be integrated as an enlarged portion of the first fluid conduit. The piston may be provided solely as a sealing element to isolate the well annulus spaces from each other, or made up by different portions having sealing characteristics to seal off the well annulus spaces and rigid characteristics for providing strength and conducting necessary operations. Further the piston may be provided in one piece or made up by two or more elements. The pistons may operate inside a casing or it may operate in an open hole which has not been cased. The piston may be provided to be moved inside the well bore or to be held in one position during its operation.

In accordance with the invention there is a communication of fluid between the adjacent well annulus spaces at each side of the piston. This may be useful in many ways, such as when setting and the retrieving the down hole well tool. The communication of fluid between the adjacent well annulus spaces may be controlled in various ways; by the differential fluid pressure over the piston, by electrical, mechanical or hydraulic signals, or by the relative movement between the first fluid conduit and a control element. The communication signals can be transmitted from the surface, or it may be sent from a downhole unit. The control element may be moved relative to the first fluid conduit or the first fluid conduit may be moved relative to the control element.

The relative movement may occur in various ways, such as for instance in the axial or the radial direction of the well tool or as a rotational movement.

In a first embodiment of the invention the piston or a portion of the piston constitutes the control element. The piston and the first fluid conduit may then be provided with recesses at their surfaces facing each other, configured to arrange for a passage for fluid communication or a closed condition determined by the relative position between the first fluid conduit and the piston. Further, the piston or the first fluid conduit may be provided with a first recess and the other of the piston or the first fluid conduit may be provided with at least two recesses. The fluid passage may be provided when portions of the first recess opening is placed in facing contact with portions of each of the two recess openings. The closed condition may be provided by arranging the opening of the first recess in facing contact with the opening of either of the two recesses. The size of the opening of the first recess is larger than the distance between the two recesses.

In accordance with a second embodiment of the invention the first fluid conduit is provided with at least one fluid passage for communication between adjacent well annulus spaces. The control element may be constituted by at least a valve element for closing and opening the fluid passage. As the skilled person will realize there are several ways a valve element may be suitable for opening and closing of the fluid passage, for example an expandable annular valve, simple bypass valve etc. The movement of the valve element for closing and opening the fluid passage may be controlled by suitable controlling means. The movement of the valve element may be controlled by mechanical devices or by electrical, mechanical, pressure or hydraulic signals or other suitable means.

In one aspect the valve element is placed adjacent an opening of the fluid passage into one of the well annulus spaces and is provided with a guide element which is accommodated in the opening of the fluid passage for guiding the movement of the valve element. The valve element(s) may alternatively be placed elsewhere in the fluid passage or close to the fluid passage for the closing and opening of the fluid passage.

In a third embodiment of the unit a controlling unit is provided for causing the movement of the piston from its initial position into a position wherein a fluid path is established for the communication between adjacent well annulus spaces at each side of the piston. This embodiment may be useful for instance in a situation wherein a rapid retrieval of the down hole well tool is necessary. The fluid path may be established by placing the piston in a position wherein a canal having openings at each side of the piston communicating with the adjacent well annulus spaces.

Alternatively a portion of the fluid passage as described in the second embodiment, may provide the fluid path, preferably that the fluid path is provided by the piston covering a middle portion of an opening of the fluid passage provided in the first fluid conduit. In this position the piston leaves a portion of the opening open at each side of the piston establishing the fluid path for fluid communication between the adjacent well annulus. In accordance with this alternative, the fluid passage is closed at one end for instance by the valve element.

In a further aspect of the third embodiment a cavity is provided in the surface of the first fluid conduit. The piston is then placed into a position covering a middle portion of a cavity thereby leaving a portion of the cavity open at each side of the piston establishing the fluid path for fluid communication between the adjacent well annulus.

The controlling unit may comprise a locking bolt or other suitable means for releasing the piston from its initial position and then securing the piston in the new position for establishment of a fluid path. Stopping means such as a stopping pin may be provided for obtaining the correct new position of the piston.

Further the tool unit may be provided with plural pistons dividing the well annulus into plural well annulus spaces. The use of this version of the invention will be described more closely when describing the figs showing an embodiment of the invention.

BRIEF DESCRIPTION OF THE DRAWINGS

An example of the unit in accordance with the invention is to be described in the following with reference to drawings, wherein.

DETAILED DESCRIPTION

Figure 1:
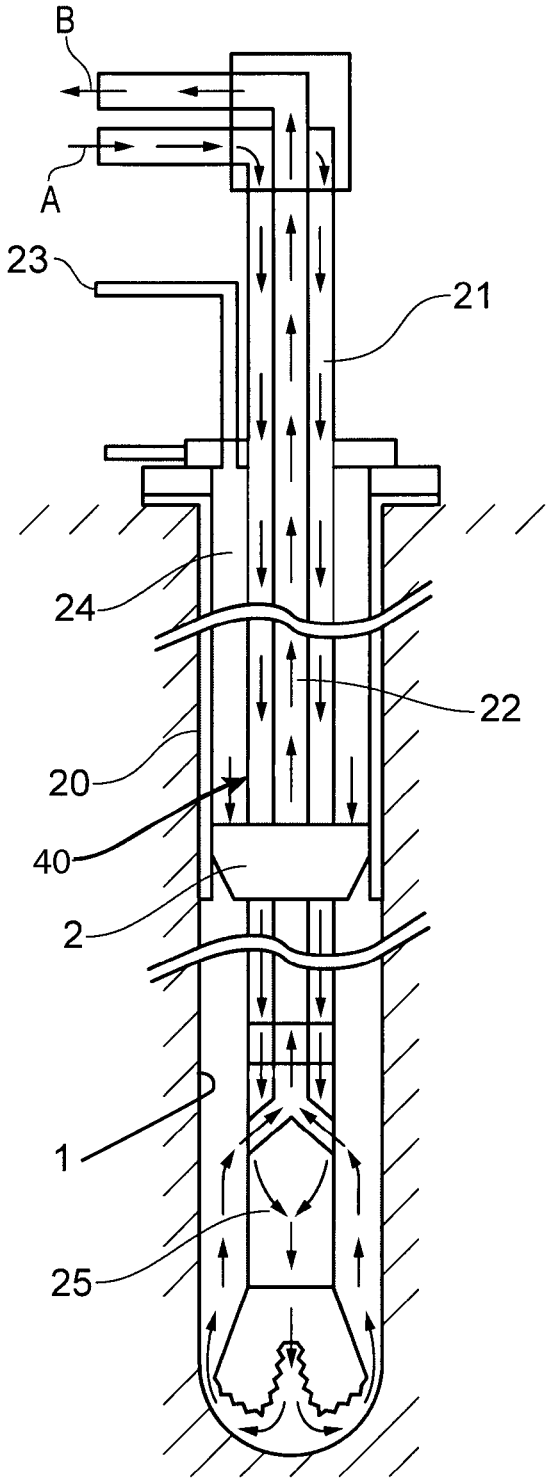
FIG. 1 is an example of one use of the unit in according to the invention.

FIG. 1 shows an example of unit of a down hole well tool with a bottom hole assembly 25 which is positioned in a well bore 1 and is to be used for a drilling operation with an upper part of the well bore being provided with a casing 20. A tool unit 40 of the down hole well tool constitutes a first fluid conduit 21 and a return fluid conduit 22 which is coaxially arranged inside the first fluid conduit 21. The first fluid to be used for drilling passes in the outer fluid path as illustrated by the arrow A, while the return fluid flows in the inner fluid path as illustrated by arrow B. An inlet 23 is shown for the supply of a pressurized fluid in a well annulus space 24 above the piston 2. The piston of the down hole well tool may be provided so that the unit may be used for the installing of a casing.

Figure 2A:
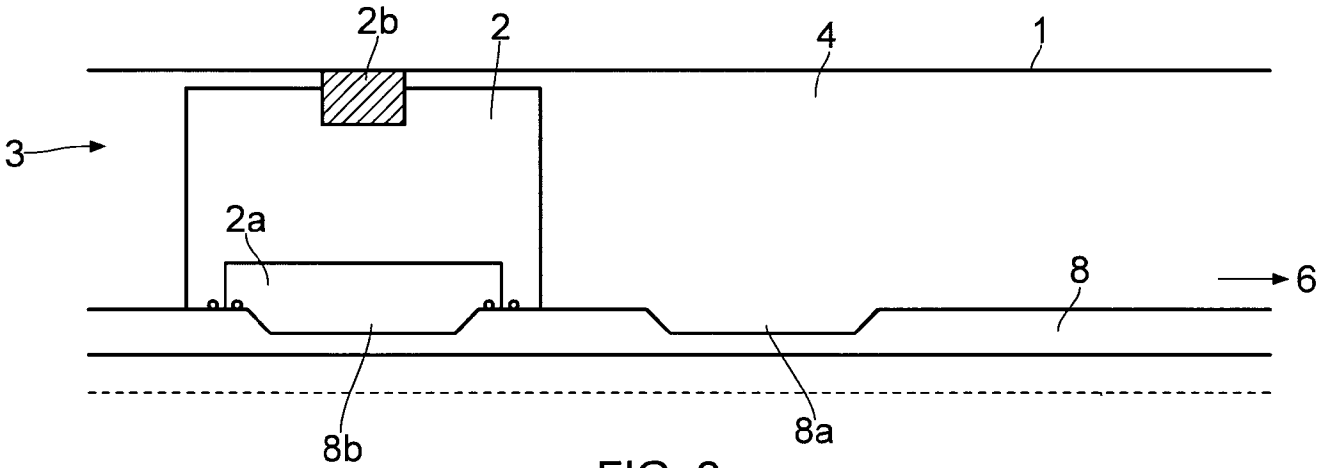
FIG. 2*a* shows the unit in a closed condition according to a first embodiment of the invention.

FIG. 2*a* shows a section of a first embodiment of the unit according to the invention wherein a down hole well tool is positioned in a well bore 1. No casing is present in the example shown in FIG. 1*a*, but as the skilled person will realize, the unit may also be used in a casing or during the installation of a casing. The piston 2 having a piston seal 2*b* is shown in the well bore separating the well annulus between the tool unit and the well bore, into a first and a second well annulus spaces 3, 4. The well annulus spaces 3, 4 are arranged displaced relative each other in the axial direction of the well bore or the tool unit. The piston 2 is provided with a recess 2*a*, and a first fluid conduit 8 is provided with two recesses 8*a*, 8*b*. In the situation as shown in FIG. 2*a*, a closed condition is shown and there is no fluid communication between the first and second well annulus spaces 3, 4.

Figure 2B:
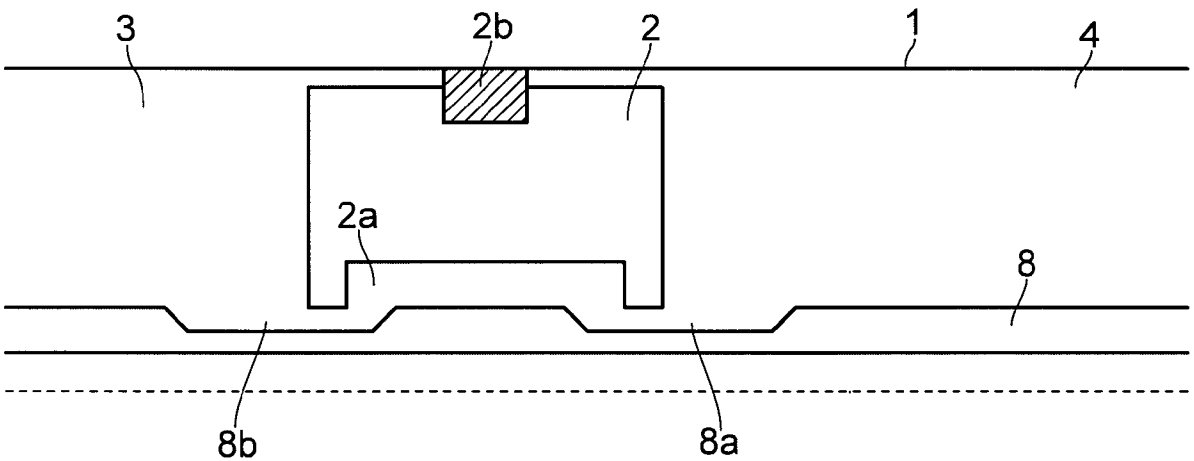
FIG. 2*b* shows the unit in an open condition according to a first embodiment of the invention.

In FIG. 2*b* the piston 2 has been displaced in an axial direction 6 corresponding to the central axis of the first fluid conduit 8, into an open condition providing a passage for fluid communication between the first and second well annulus space 3, 4, making use of the configuration of the recesses 2*a*, 8*a*, 8*b*.

The displacement between the piston 2 and the first fluid conduit 8 may also be conducted by displacing the first fluid conduit 8 relative to the piston, thereby providing for the relative movement between the first fluid conduit 8 and the piston 2 to take place. The recesses 2*a*, 8*a*, 8*b* may also be given other shapes than the ones shown in FIGS. 2*a* and 2*b* to arrange for a closed and an open condition to take place depending on the relative position between the first fluid conduit and the piston.

Figure 3A:
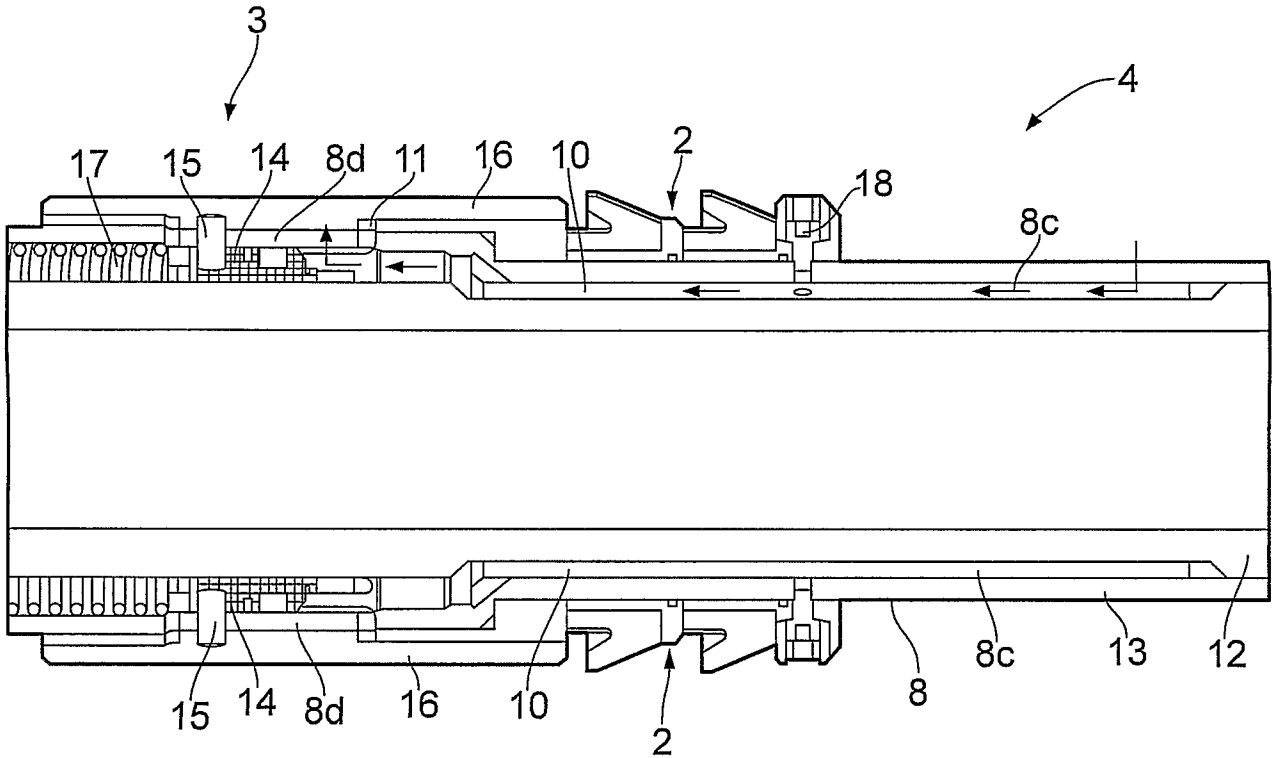
FIG. 3*a* shows the unit in an open a closed condition according to a second embodiment of the invention.

FIG. 3*a* shows a second embodiment of the unit. The first fluid conduit 8 has a fluid passage 10 for communication of fluid between the first and second well annulus spaces 3, 4. In the example on FIG. 3*a*, the first fluid conduit 8 comprises the drill string 12 and a sleeve 13 for the drill string 12. The flow of fluid from the second to the first well annulus space 3, 4 is illustrated by arrows in the passage 10. The passage 10 ends into openings 8*d* facing the first well annulus space 3 and openings 8*c* facing the second well annulus space 4 for the communication of fluid into and out of the passage 10. In the FIGS. 3*a* and 3*b*, the openings 8*c* and 8*d* are shaped as opening slits, but of course also alternative shapes may be used here. The fluid is communicated through openings 8*d* and into holes 11 provided in a protecting sleeve 16 arranged around the first fluid conduit 8. A valve element 14 for closing and opening the fluid passage 10 is shown having at least one guide element 15 arranged projecting in the opening 8*d* for the guidance of the valve element 14. The movement of the valve element 14 is controlled by a spring element 17. As the skilled person will understand also other suitable means may be used for causing the movement of the valve element 14. In an alternative embodiment the valve element 14 may be provided as an enlarged portion of the drill string 12, wherein the drill string 12 with the integrated valve element may be provided to be moved relative to piston 2 for the opening and closing of the opening 8*d* and thereby the fluid passage 10.

A locking bolt 18 is provided to ensure that the piston is held in the position as shown in FIG. 3*a*. The locking bolt 18 may be releasably arranged.

Figure 3B:
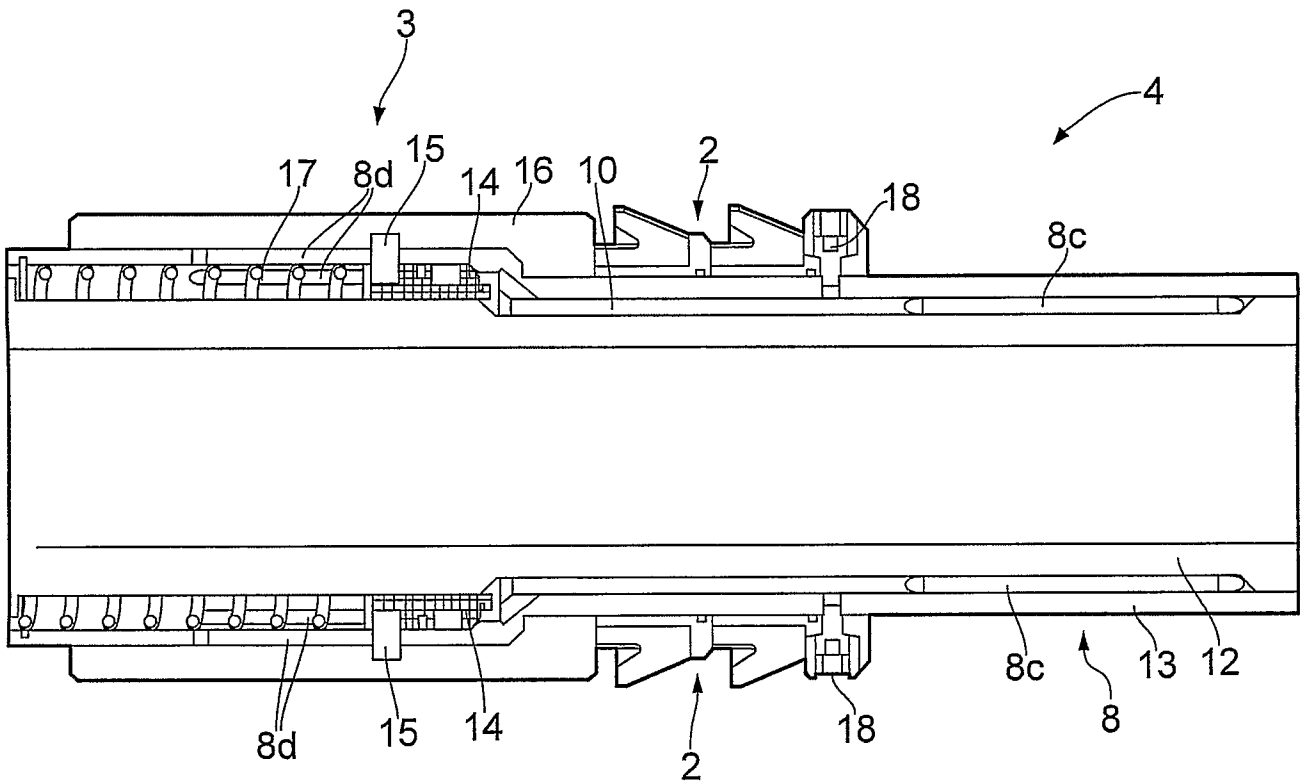
FIG. 3*b* shows the unit in a closed condition according to a second embodiment of the invention.

In FIG. 3*b* a closed condition is achieved by sliding the valve element 14 into a position closing off the fluid passage 10 and thereby preventing communication of fluid between the first and second well annulus spaces 3, 4. As seen from FIG. 3*b* in a closing condition the spring element 17 is stretched and the guide element 15 is positioned in the end of the opening 8*d*. To obtain an open condition, a signal is transferred to the spring element bringing it into an unloaded condition and thereby moving the guide element 15 (and thereby the valve element) to the other end of the opening 8*d*, clearing the passage 10 for fluid to pass through. As mentioned earlier the movement of the valve element may by carried out by other means than a spring element, further the configuration of the valve element, the position of the valve element in closed and open condition, the guide element and the opening may be provided otherwise to arrange for the closing and opening of the passage.

Figure 4:
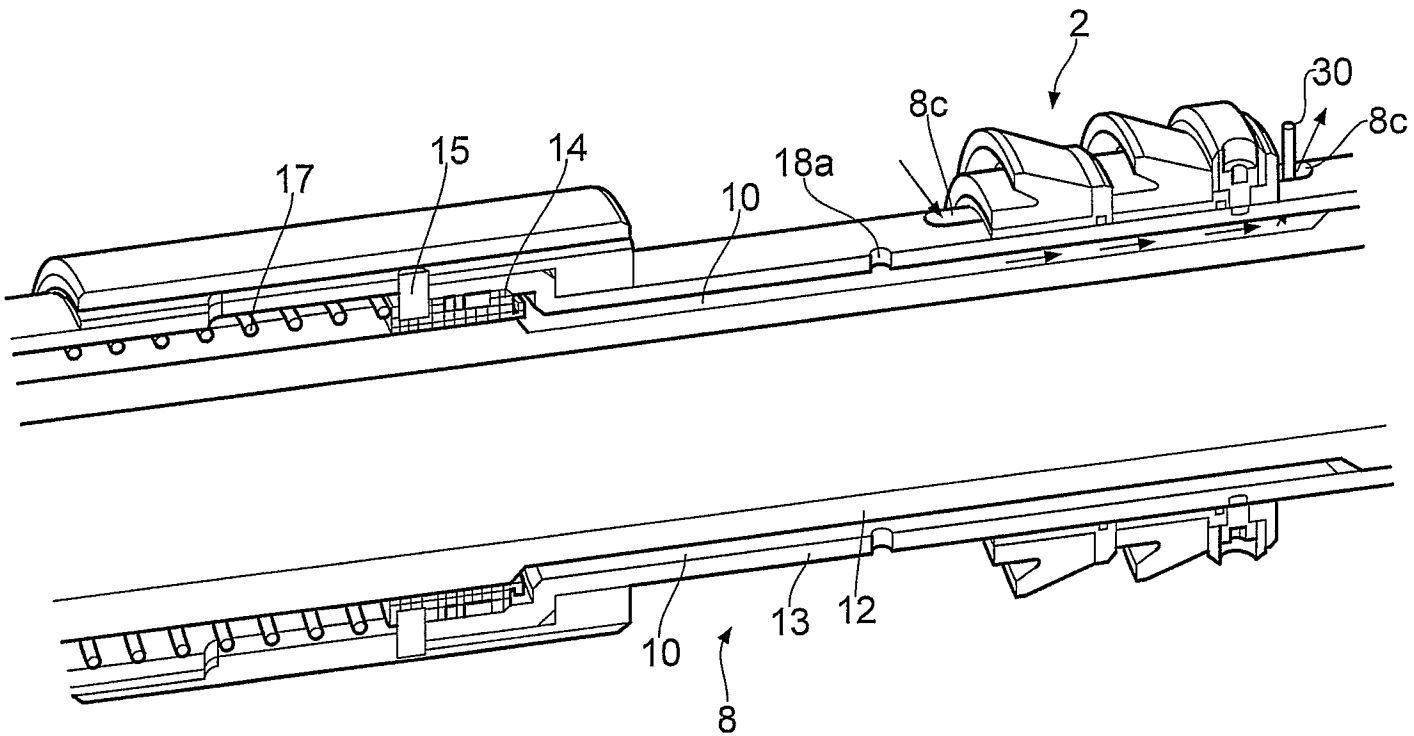
FIG. 4 shows a third embodiment of the invention.

FIG. 4 shows an embodiment of the invention to be used when an urgent situation arises, for instance if there is a need for rapid retrieval of the down hole well tool and not enough time to open the fluid passage in accordance with normal operation mode as presented in FIGS. 3*a*, 3*b*. In this urgent operation mode the fluid passage is kept closed by the valve element, and controlling means such as the releasable locking bolt 18 is released from engagement with a hole 18*a*. The piston 2 is thereby free to move into a position covering a middle portion of the opening 8*c* of the fluid passage in the surface of the first fluid conduit 8. This position of the piston 2 leaves the opening 8*c* open at each side of the piston for fluid communication between the adjacent well annulus. Stopping means such as a stop element 30 is provided to make sure the piston is correctly positioned over the opening 8*c*.

Figure 5:
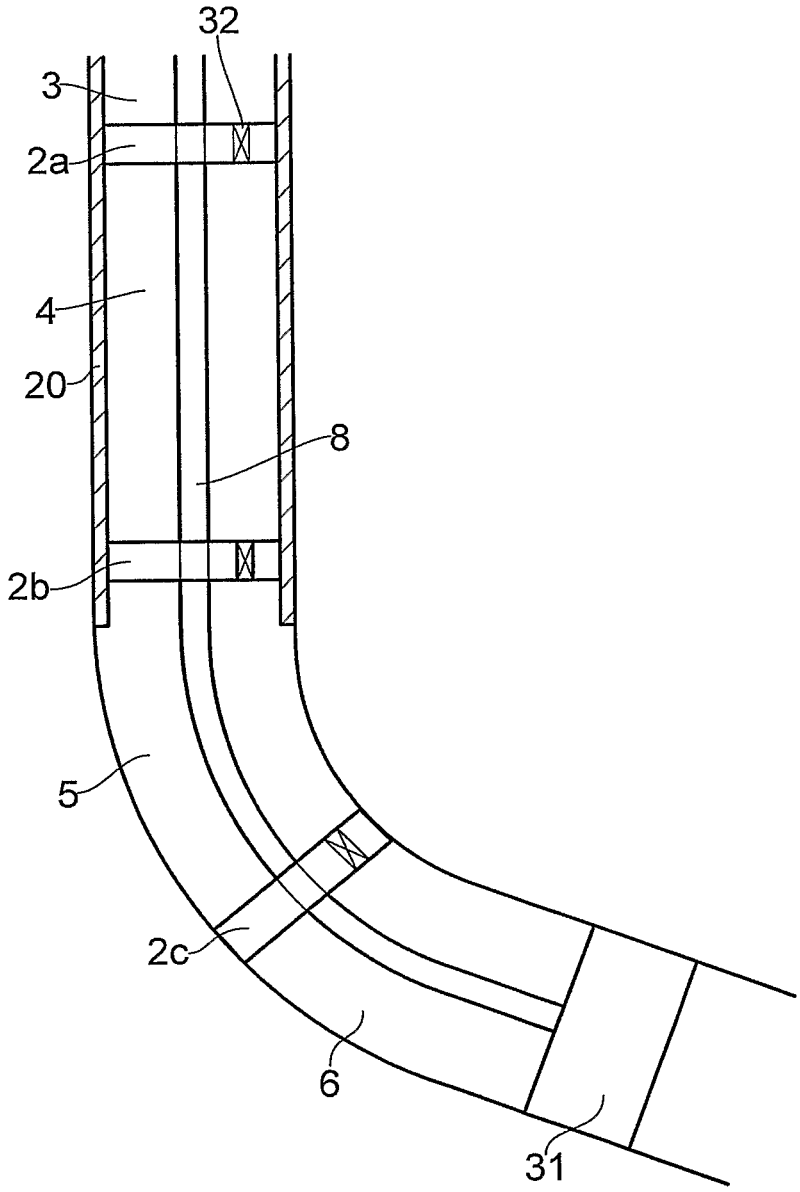
FIG. 5 shows an embodiment of the unit according to the invention wherein a number of pistons are included

FIG. 5 shows the first fluid conduit 8 having a drill tool 31 and is provided with several pistons 2*a*, 2*b*, 2*c*, dividing the well annulus into plural well annulus spaces 3, 4, 5, 6. The communication of fluid between the adjacent well annulus spaces is illustrated by the element 32 and may be carried out in accordance with the embodiments of the invention as presented in the FIGS. 2*a*, 2*b*, 3*a*, 3*b* and 4. This arrangement of plural pistons may be useful when installing the casing 20, as the pressure necessary for setting the casing 20 may be distributed among the plural pistons in replacement of using only one piston for the setting of the casing. Further, fluid with individual characteristics may be adapted for use within the specific well annulus space 3, 4, 5, 6, and thus for instance the density of the fluid in the specific well annulus space 3, 4, 5, 6 may be chosen to fit the surrounding formation wherein the drilling is taking place. The pressure in one individual well annulus spaces may or may not be equal to the pressure in the other well annulus spaces. The distribution of pressure on plural pistons may be advantageous to the piston seal as the pressure exerted on each of the pistons is only a portion of the pressure exerted when only one piston is present in the unit.

What is claimed is:

1. A unit for a down hole well tool comprising a tool unit comprising at least one first fluid conduit and a return fluid conduit, wherein the tool unit in use forms a well annulus between the tool unit and the well bore, wherein the tool unit is arranged with at least one piston provided for dividing the well annulus into at least two well annulus spaces, wherein the communication of fluid between the adjacent well annulus spaces at each side of the piston is controlled by a relative movement between the first fluid conduit and at least a portion of the piston in an axial direction of the well tool.

2. A unit in accordance with claim 1, wherein either the piston or the first fluid conduit is provided with a first recess and the other of the piston or the first fluid conduit is provided with at least two recesses.

3. A unit in accordance with claim 2, wherein a fluid passage is provided when portions of the first recess opening is placed in facing contact with portions of each of the two recess openings, and wherein a closed condition is provided by arranging the opening of the first recess in facing contact with the opening of either of the two recesses.

4. A unit in accordance with claim 2, wherein the size of the opening of the first recess is larger than the distance between the two recesses.

5. A unit in accordance with claim 1 wherein the tool unit is provided with plural pistons dividing the well annulus into plural well annulus spaces.

6. A unit for a down hole well tool comprising a tool unit comprising at least one first fluid conduit and a return fluid conduit, wherein the tool unit in use forms a well annulus between the tool unit and the well bore, wherein the tool unit is arranged with at least one piston provided for dividing the well annulus into at least two well annulus spaces, wherein the communication of fluid between the adjacent well annulus spaces at each side of the piston is controlled by a relative movement between the first fluid conduit and a control element, wherein the piston and the first fluid conduit are provided with recesses at their surfaces facing each other, configured to arrange for a passage for fluid communication or a closed condition determined by the relative position between the first fluid conduit and the piston.

7. A unit for a down hole well tool, comprising:

a tool unit comprising a first fluid conduit and a return fluid conduit arranged inside the first fluid conduit, the tool unit being adapted for arrangement in a well bore such that a well annulus is formed between the tool unit and a wall of the well bore;

a piston disposed about the first fluid conduit, the piston being configured to divide the well annulus into a first well annulus space above the piston and a second well annulus space below the piston;

a fluid passage formed in a wall of the first fluid conduit, the fluid passage having a first opening for communication with the first well annulus space and a second opening for communication with the second well annulus space; and a valve member disposed about the first fluid conduit for closing and opening the fluid passage.

8. A unit in accordance with claim 7, wherein the valve member comprises a valve element that is movable relative to the first fluid conduit in an axial direction of the well tool to control the closing and opening of the fluid passage and control means for controlling movement of the valve element.

9. A unit in accordance with claim 7, further comprising a controlling unit provided for causing the movement of the piston away from an initial position into a position wherein a fluid path is established for communication of fluid between the well annulus spaces.

10. A unit in accordance with claim 9, wherein the fluid path is provided by the piston covering a middle portion of a cavity in a wall of the first fluid conduit, thereby leaving a portion of the cavity open at each side of the piston establishing the fluid path for fluid communication between the well annulus spaces.

11. A unit in accordance with claim 9, wherein the controlling unit comprises a locking bolt and/or stopping means is provided for the correct position of the piston.

12. A unit in accordance with claim 7, further comprising at least one additional piston configured to further divide the well annulus into well annulus spaces.

13. A unit in accordance with claim 8, wherein the control means comprises a spring element.

* * * * *